United States Patent [19]

Hampton

[11] Patent Number: 5,065,687

[45] Date of Patent: Nov. 19, 1991

[54] MOORING SYSTEM

[76] Inventor: James E. Hampton, c/o Hampco, Wood International Centre, Aberdeen, Scotland, ABL 4AG

[21] Appl. No.: 497,138

[22] Filed: Mar. 21, 1990

[30] Foreign Application Priority Data

Apr. 11, 1989 [GB] United Kingdom ..... 8097/89

[51] Int. Cl.[5] ..... B63B 21/00

[52] U.S. Cl. ..... 114/230; 441/4

[58] Field of Search ..... 114/230, 293, 247, 253; 441/3, 4, 5

[56] References Cited

U.S. PATENT DOCUMENTS

| | | | |
|---|---|---|---|
| 3,863,590 | 2/1975 | Karl et al. | 441/4 |
| 4,200,052 | 4/1980 | Cunningham et al. | 114/230 |
| 4,768,984 | 9/1988 | De Oliveira et al. | 441/3 |

FOREIGN PATENT DOCUMENTS

| | | | |
|---|---|---|---|
| 155088 | 7/1986 | Japan | 441/3 |

OTHER PUBLICATIONS

Sterzenbach. "Operational Problems of Offshore Oil Loading and Possible Solutions to Overcome the Weather Limitations", Presented at the 21st Annual Offshore Technology Conference in Houston, Texas During May 1-4, 1989.

*Primary Examiner*—Jesus D. Sotelo
*Assistant Examiner*—Stephen P. Avila
*Attorney, Agent, or Firm*—Bacon & Thomas

[57] ABSTRACT

A mooring system for locating a buoy 33 adjacent to a moored vessel 21, in which the buoy is connected to two horizontally spaced apart points on the vessel, and is also connected to the seabed such that it floats with its connections to the two spaced apart points in tension. The buoy is advantageously connected to the seabed by a single tether 27 extending downwardly from the buoy 33 in such a manner to maintain a predetermined minimum distance between the buoy and the vessel. The mooring system may have provision for a tanker 43 to ride to the buoy 33.

7 Claims, 11 Drawing Sheets

MOORING SYSTEM

The invention relates to a mooring system, and is particularly concerned with the use of such a system as part of an arrangement for the loading of tankers with oil from floating production facilities at offshore locations.

Heretofor it has been known for tankers to be loaded with oil from floating or compliant loading structures which have been permanently moored at an offshore site. These loading structures have been supplied with oil for export from nearby production facilities, through fixed pipelines running on the seabed between the respective production facility and loading structure.

The invention provides a mooring system for locating a buoy adjacent to a moored vessel, in which the buoy is connected to two horizontally spaced apart points on the vessel, and is also connected to the seabed such that it floats with its connections to the two spaced apart points in tension.

It is preferred that there is a compensation mechanism on the buoy or the vessel to tension one of the connections there between.

It is further preferred that there are individual compensation mechanisms to tension both of the connections, such that both connections may be tensioned equally and simultaneously.

It is also preferred that the buoy may be controlled to translate laterally with respect to the vessel so to make limited lateral excursions under the influence of the connections.

In one form it is preferred that the buoy is connected to the seabed by a single tether extending downwardly from the buoy in such a manner to maintain a predetermined minimum distance between the buoy and the vessel.

In this form it is further preferred that the lower end of the tether is connected to a spread of anchors on the seabed.

The mooring system may have provision for a tanker to ride to the buoy.

The invention also provides a loading arrangement comprising a loading buoy located by the mooring system described above, in which there is a floating transfer hose between the vessel and the buoy.

Preferably, there is one or more floating transfer hose(s) between the buoy and the tanker.

A specific embodiment of the invention will now be described by way of example with reference to the accompanying drawings, in which:

FIGS 1 to 7 show diagramatically a sequence of events in the installation and use of a loading arrangement;

in FIGS. 5 to 7.

Figure 4:
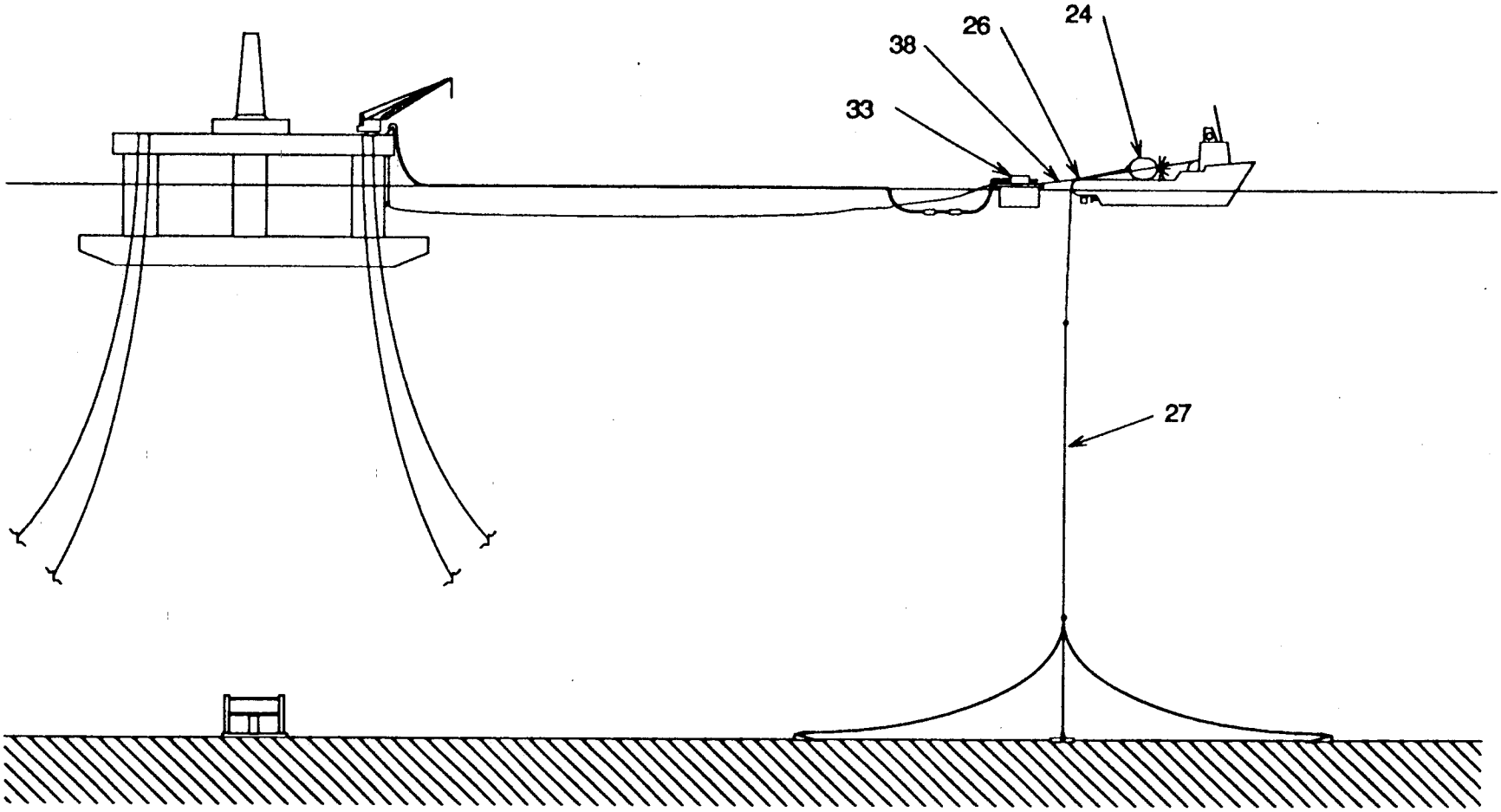

FIG. 1 shows a floating production facility including a semi-submersible vessel 21. This vessel may have been converted from a semi-submersible drilling rig. The vessel 21 is moored over a seabed satellite wellhead 22 by an eight point catenary mooring system 23.

Floating adjacent to the vessel 21 is a marker buoy 24, secured by a wireline 25 and a connecting link 26 to a mooring cable 27. The lower end of the mooring cable 27 is secured to an anchor cluster or spread comprising mooring chains 28 and anchors 29.

A workboat 31 is shown adjacent to the marker buoy 24. It may be assumed that the vessel 21 has pretensioned its own mooring system 23; and that the workboat 31 has deployed and pretensioned the anchor spread beneath the marker buoy 24.

Figure 2:
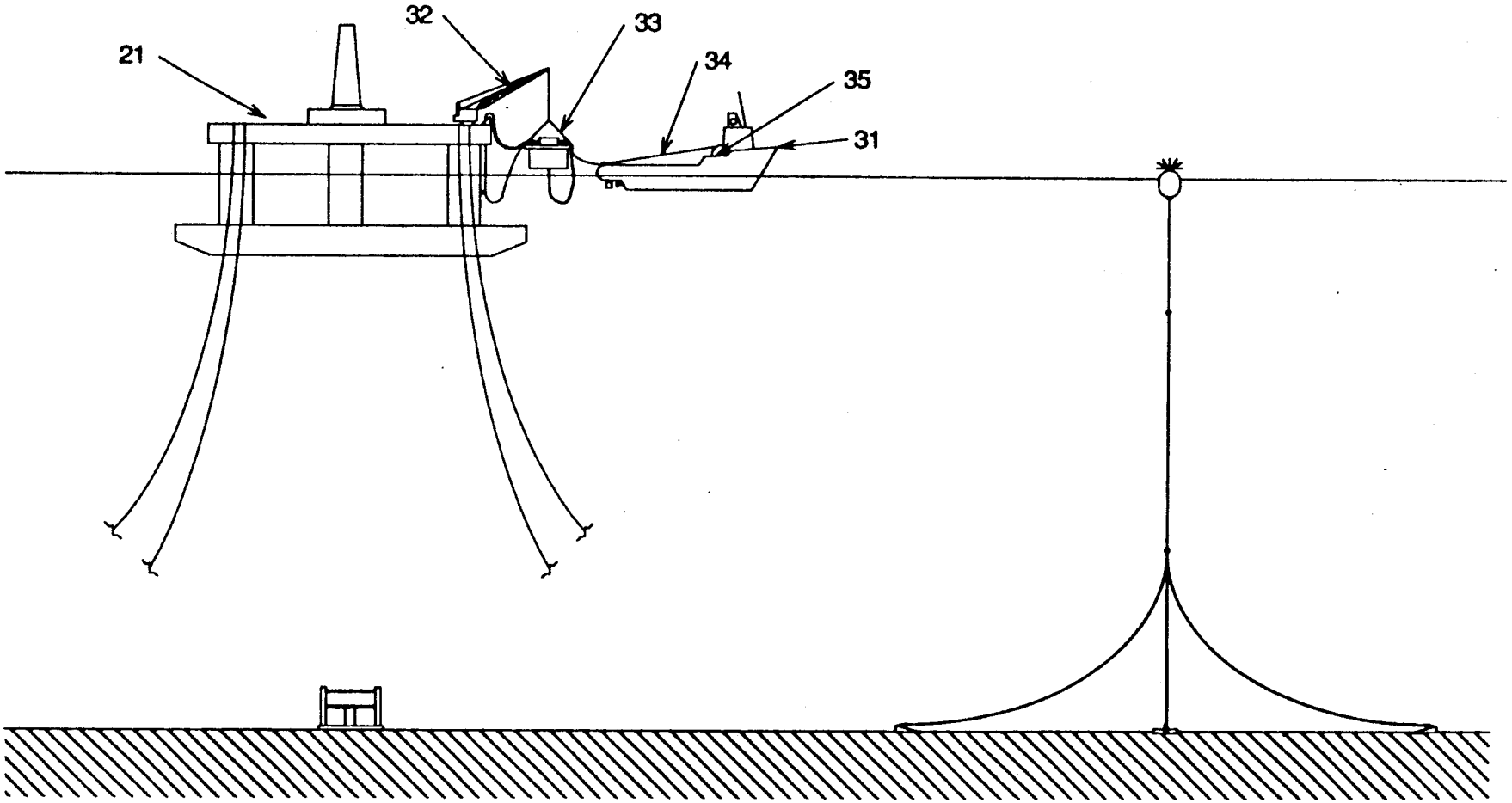

As shown in FIG. 2, a crane 32 on the vessel 21 offloads a loading buoy 33, with a mooring cable and transfer hoses already attached thereto. The loading buoy 33 is connected by a wire 34 to a winch 35 on the workboat 31.

Figure 3:
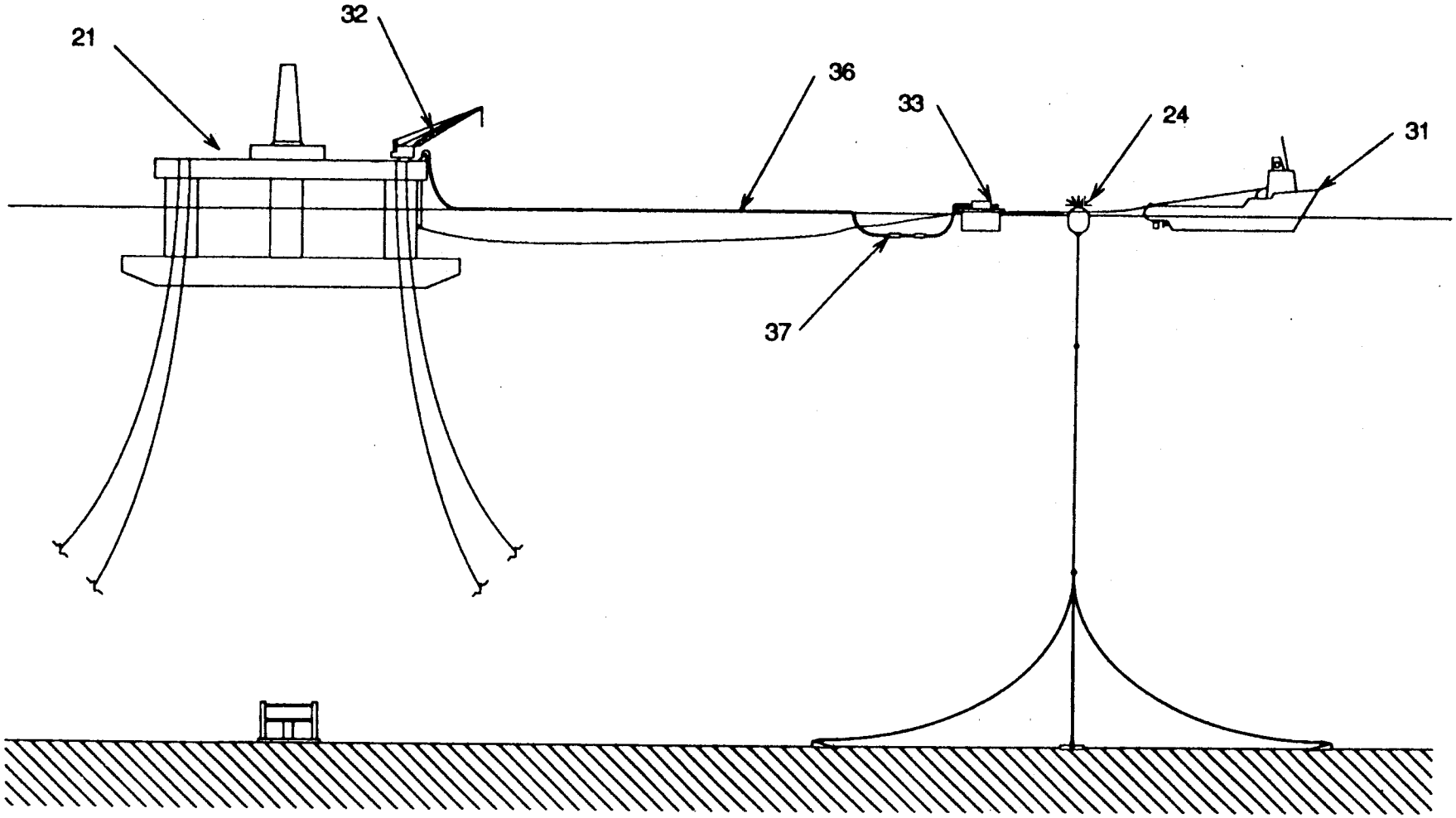
Figure 4:
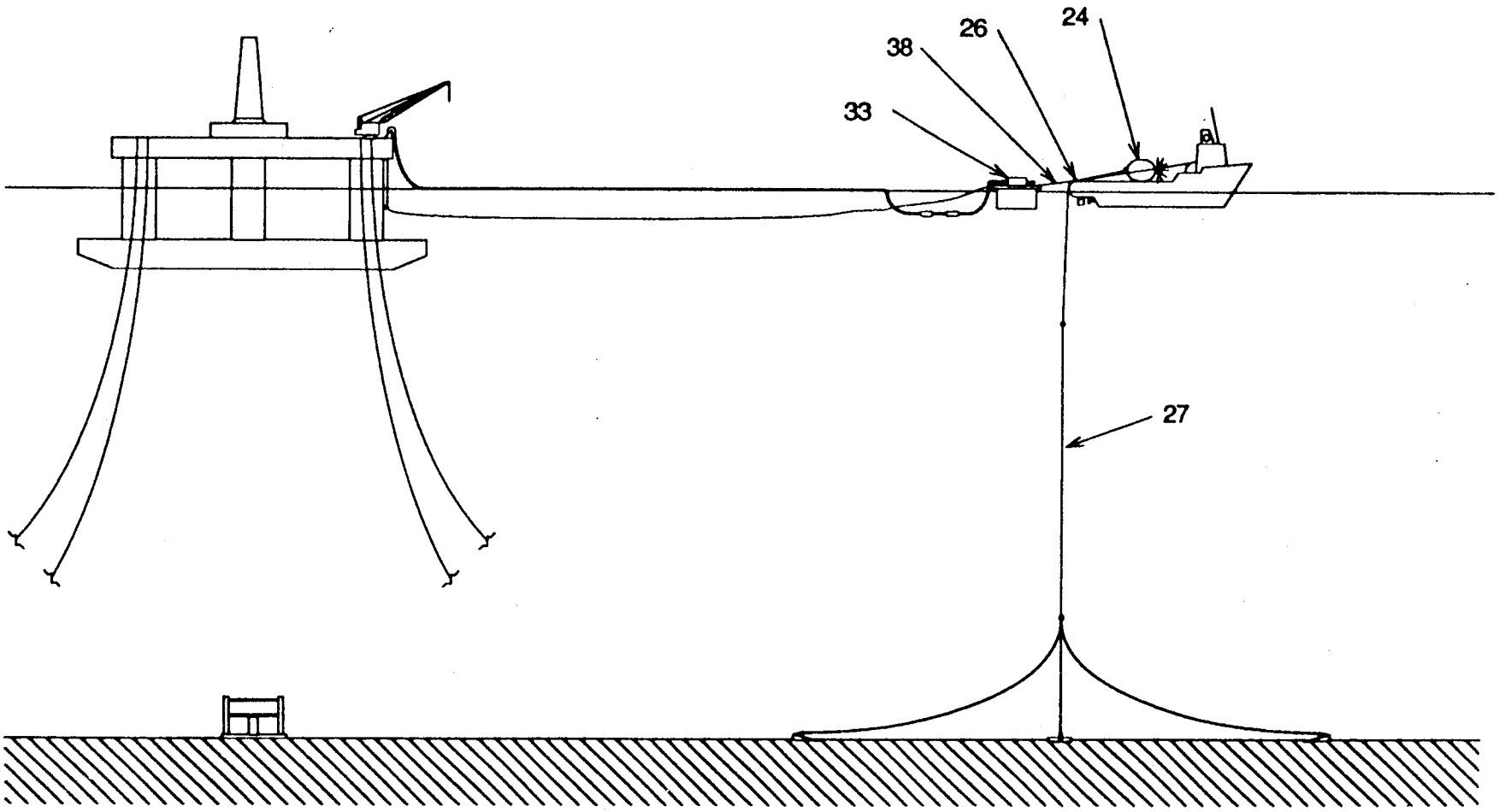

In FIG. 3 the loading buoy 33 has been lowered into the water and released from the crane 32, and is being drawn away from the vessel 21 by the workboat 31. The workboat then tows the loading buoy to the marker buoy 24.

A floating transfer line or hose 36, with a weighted section 37, lies in the water between the vessel 21 and the loading buoy 33.

In FIG. 4 the loading buoy tow line (wire 34) has been chocked off on the deck of the workboat 31. The marker buoy 24 has been hauled on board and secured on the workboat 31, and has been disconnected from its anchor cable (wire line 25). The connecting link 26 and upper part of mooring cable 27 are also held on the workboat, and cable 38 of the loading buoy 33 is joined to the connecting link 26.

Figure 5:
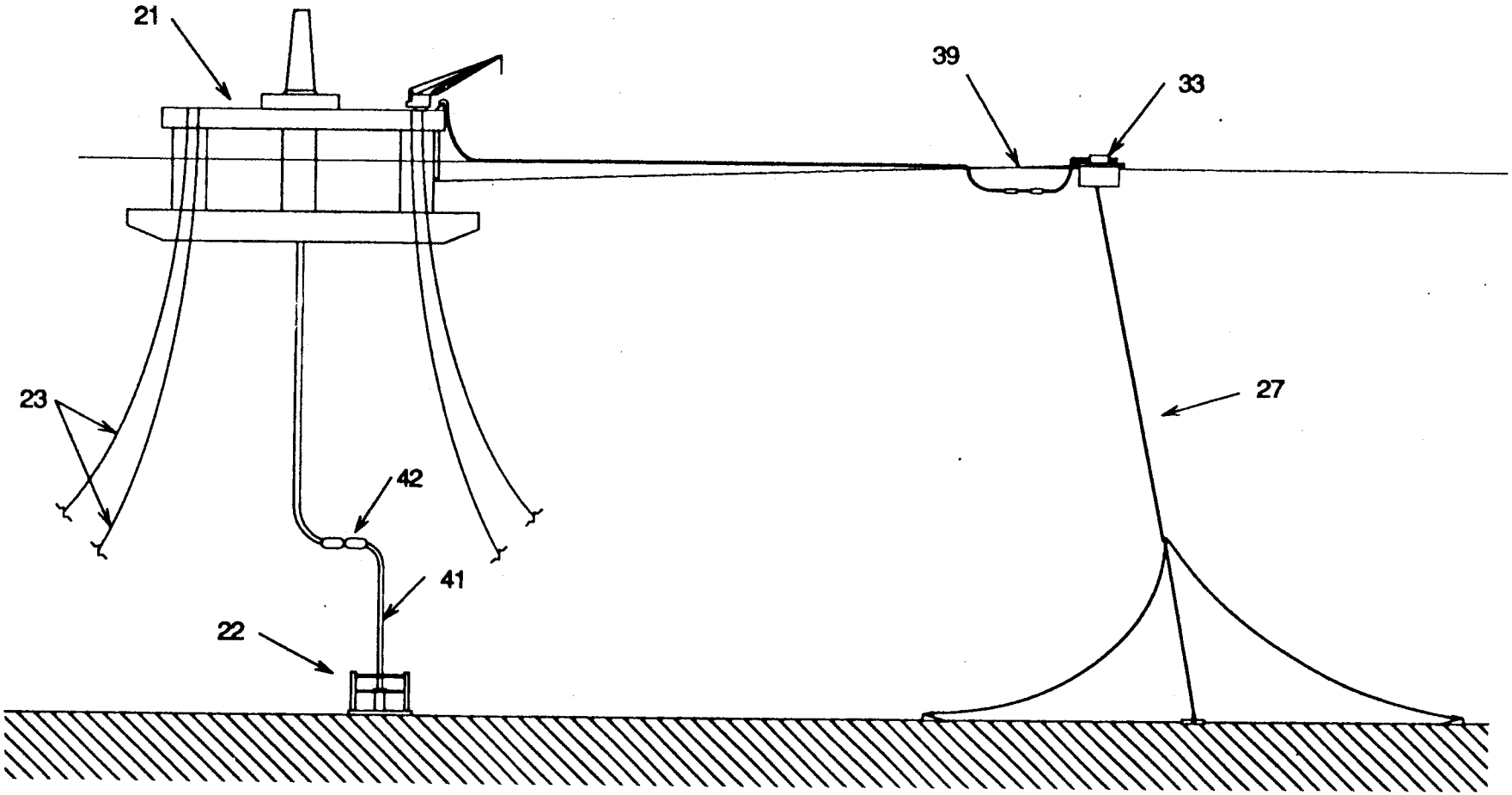

FIG. 5 illustrates the situation when the mooring system is complete. The mooring lines have been tensioned so that the mooring cable 27 leading up from the anchor spread is now disposed to draw the loading buoy 33 away from the vessel 21 against buoy mooring cables or connections 39. These cables 39 are attached to two fairleaders which are spaced apart horizontally on the vessel (The arrangement in plan of the connections 39 can be seen in FIG. 7).

FIG. 5 also shows how the wellhead 22 is connected to the vessel 21 by a flexible riser 41 with intermediate buoyancy units 42, which allow small movements of the vessel with respect to the well 22. The eight point mooring system 23 can be adjusted as necessary to position the vessel 21.

Figure 6:
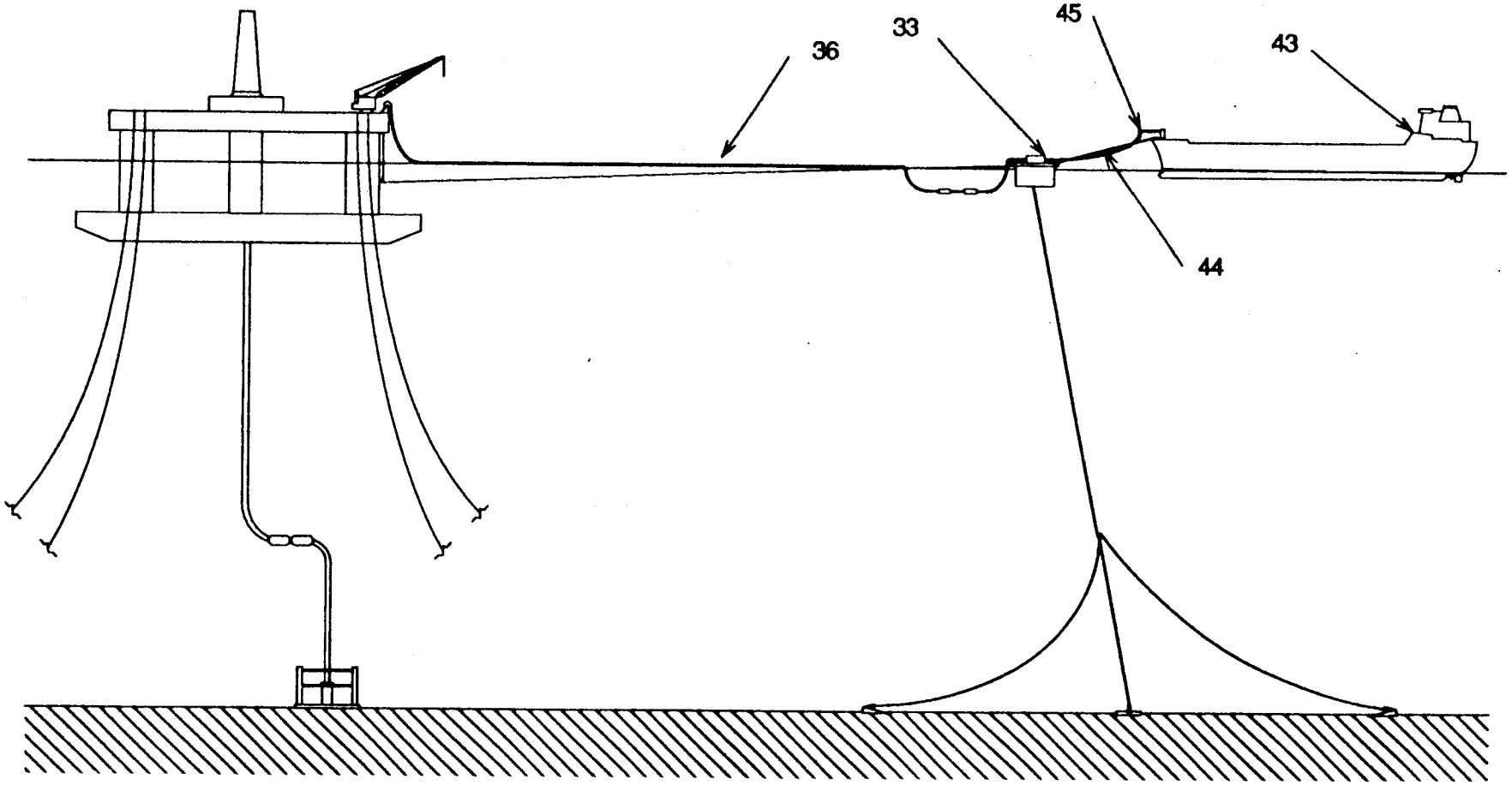
Figure 7:
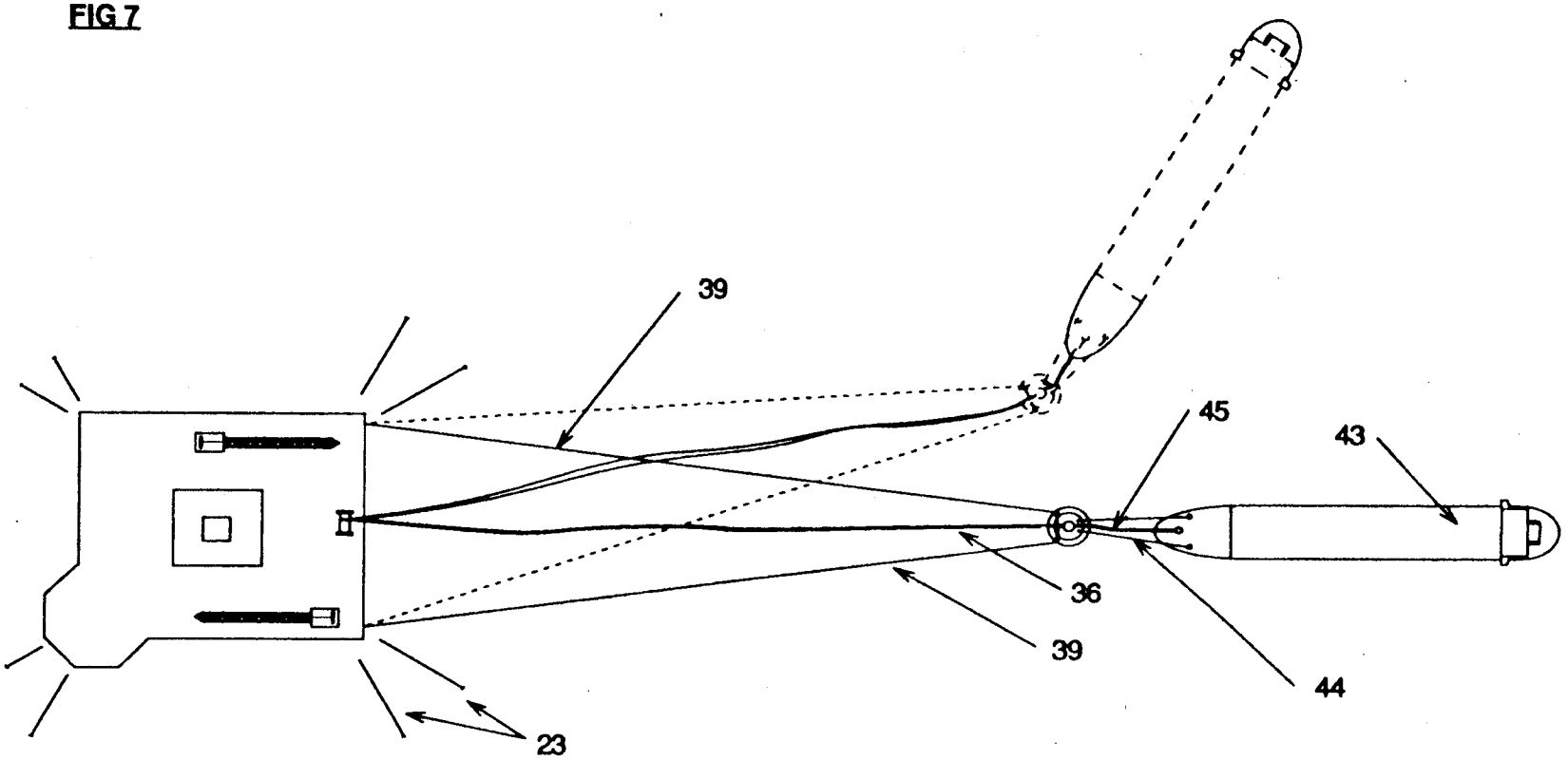

In FIGS. 6 and 7 a tanker 43 is shown riding at the loading buoy 33. Advantageously, the buoy 33 is spaced from the vessel 21 by a distance greater than the length of the longest tanker which is expected to load at the buoy.

The tanker 43 is connected to the loading buoy by mooring lines 44 and loading hose 45. In this way oil may be loaded from the vessel 21 via floating transfer hose 36, loading buoy 33, and loading hose 45.

An alternative position for the tanker (shown in dotted lines in FIG. 7) illustrates how controlled tensioning of the connections 39 can change the position of the loading buoy 33 to suit the direction in which the prevailing wind or current cause the tanker to ride to the mooring system.

It is assumed that a loading buoy is located both at the forward and the aft ends of vessel 21. Because of the mooring lines 39 connecting the buoy 33 to the vessel 21, the tanker 43 is only allowed to weathervane through a 180° arc. Once the weather-vaning limit is reached, the tanker must disconnect and relocate to the buoy at the other end of the vessel.

Figure 8:
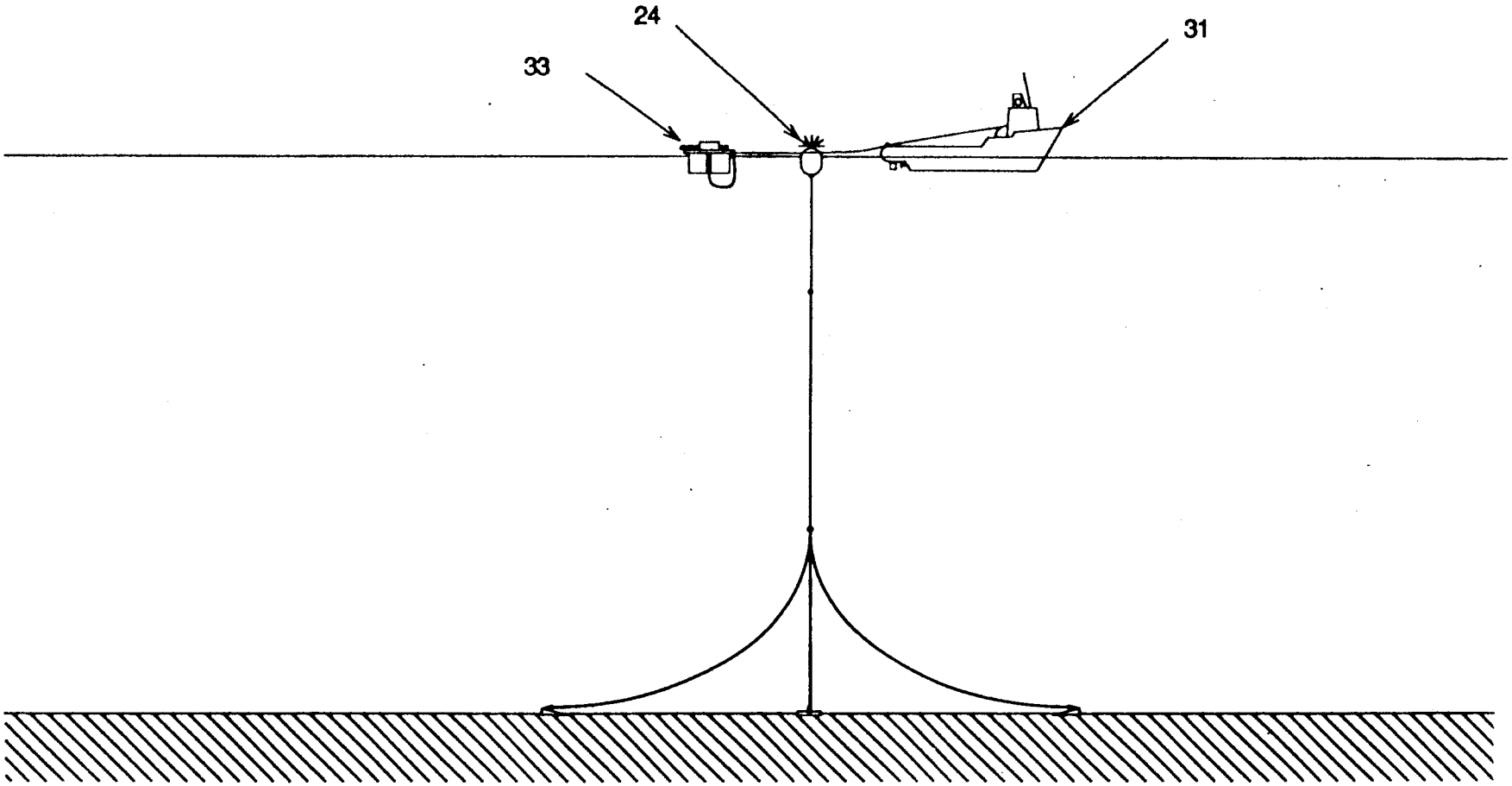
FIGS. 8 to 10 show diagramatically an alternative method of installing a loading buoy forming an important part of the loading arrangement as shown e.g.
Figure 9:
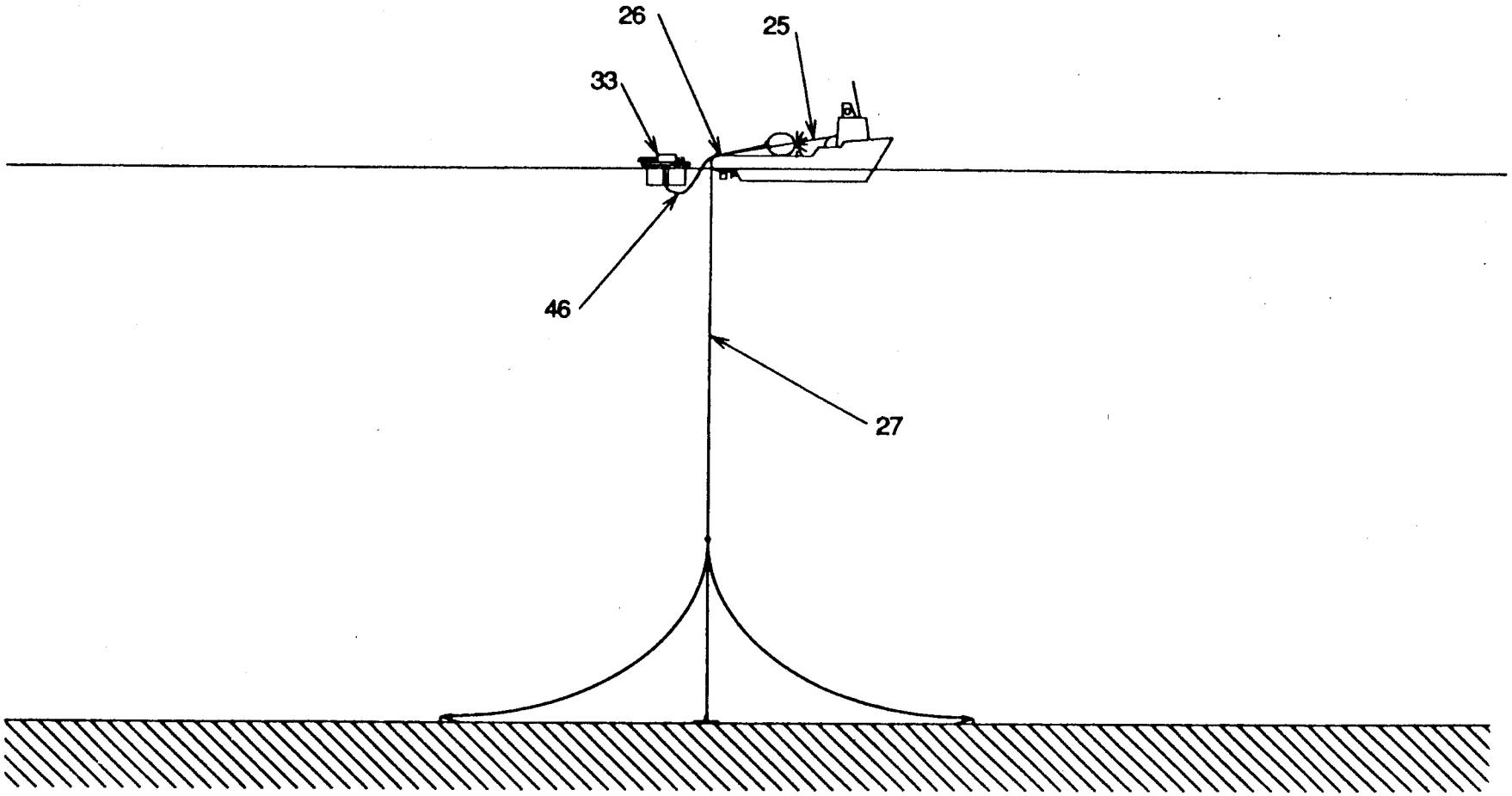
Figure 10:
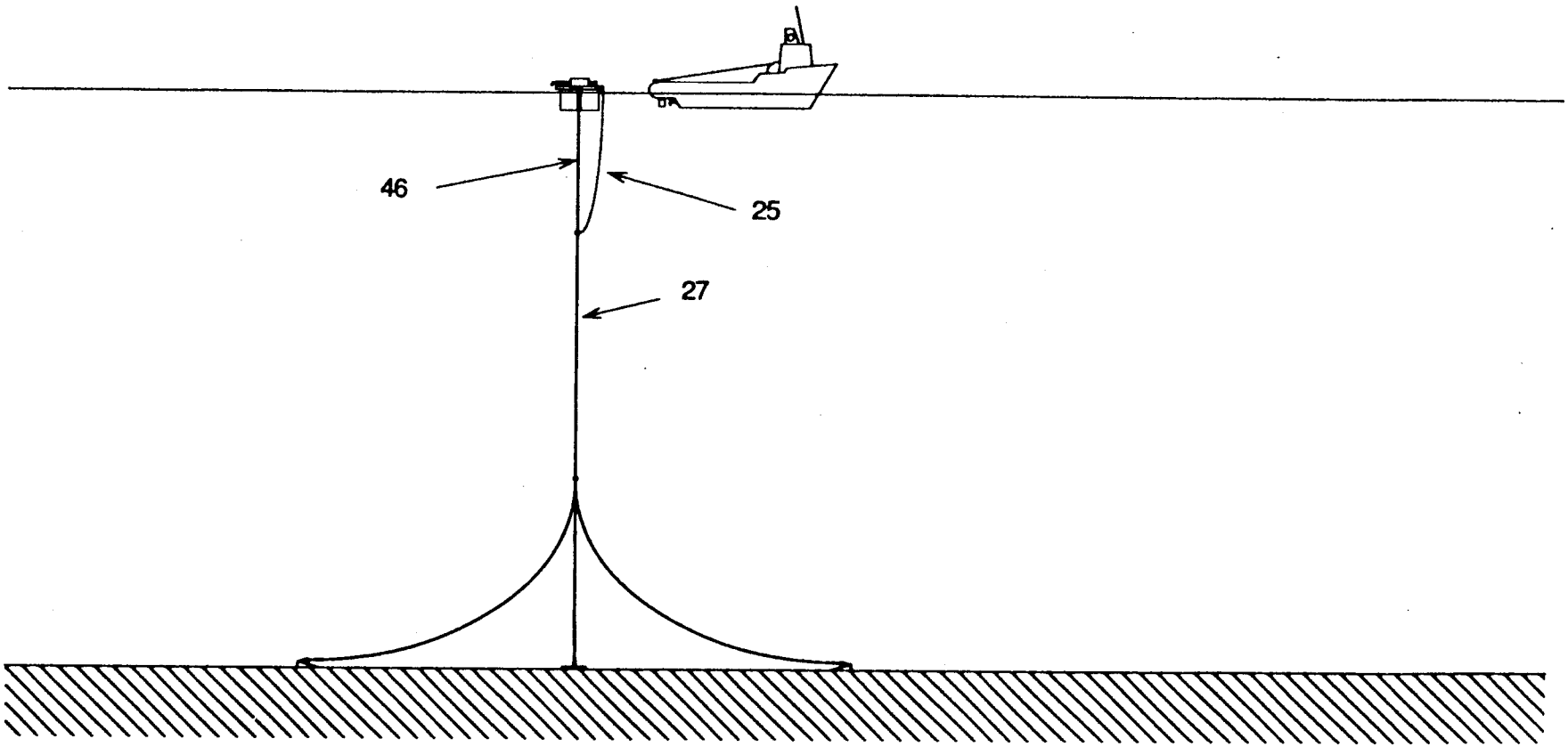

An alternative method of installing the loading buoy on station is shown in FIGS. 8 to 10. In this method the loading buoy 33 is towed onto station by the workboat 31 (FIG. 8). The marker buoy 24 is hauled on board the work boat, secured, and disconnected from wireline 25 as before; and the connecting link 26 of mooring cable 27 is connected to a mooring cable 46 of the loading buoy 33.

The marker buoy wire line 25 is then reconnected to the loading buoy 33 for subsequent contingencies (FIG. 9). The mooring cable 27 is then tensioned by a winch on the loading buoy (FIG. 10). The loading buoy 33 can then be drawn towards the vessel 21 (not shown in FIGS. 8 to 10) as before.

Figure 11:
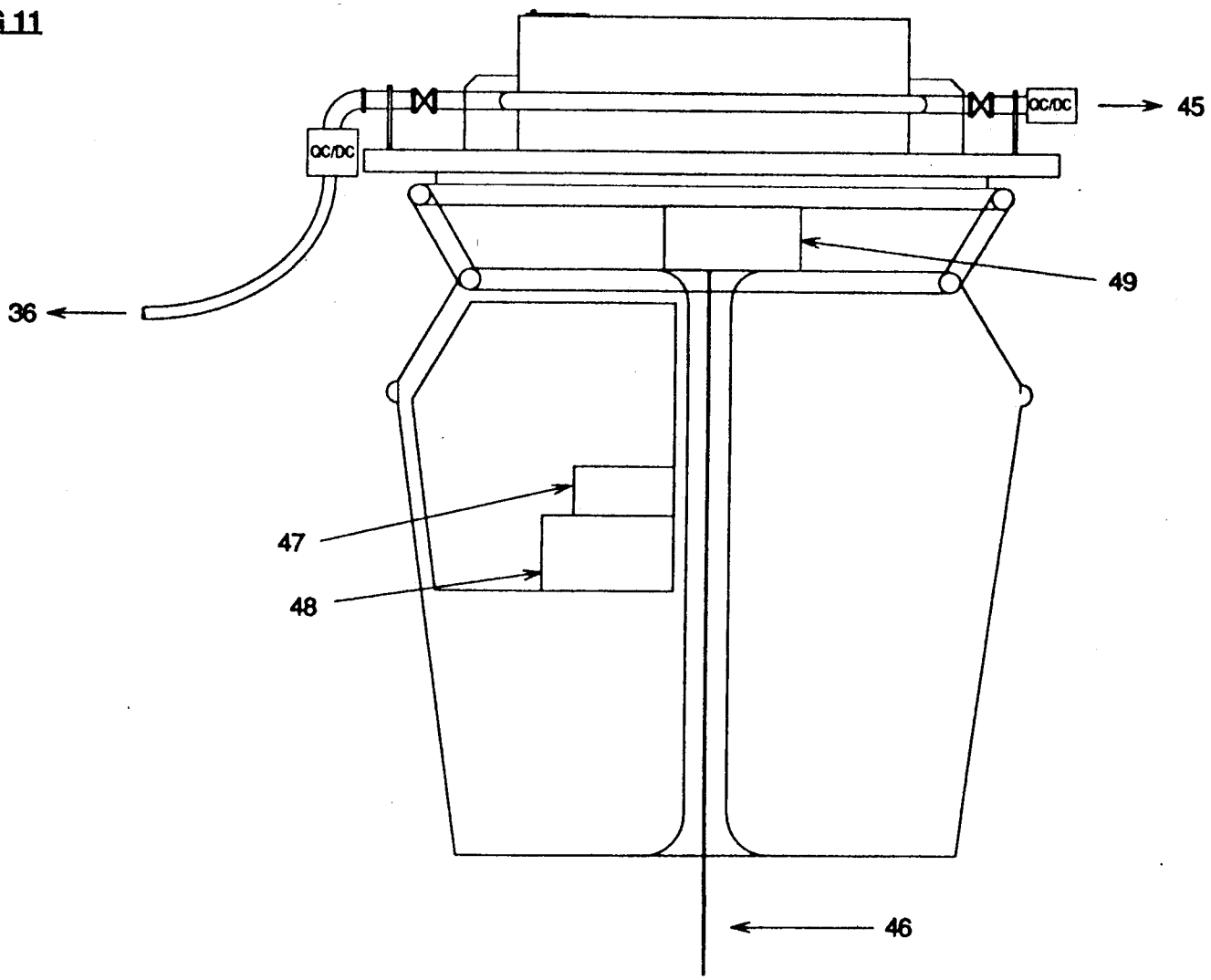
FIG. 11 is a diagramatic view of the loading buoy shown in the foregoing FIGS. 8 to 10.

FIG. 11 shows in diagramatic cross section a schematic representation of the loading buoy 33. In this instance, (as in FIGS. 8 to 10) the mooring cable 46, which is connected to the mooring cable 27 and thus to the anchor cluster, is lead onto the loading buoy through an aperture in the base of the buoy. As an alternative, shown in FIGS. 3 to 6, the mooring line may be connected to a winch on the deck of the loading buoy. It is a feature of the invention that the buoy 33 incorporates its own fuel supply 47, generator 48 and powered winch 49.

By using the loading arrangement shown particularly in FIGS. 6 and 7, a shuttle tanker can be arranged to ride at a loading buoy adjacent to a vessel of a floating production facility. The tanker can ride at a wide range of angles with resect to the vessel, and the anchor spread and two connection cables can [e tensioned to keep the buoy off the vessel, and so keep the transfer and loading hoses free of interference.

The system is intended to tether the tanker to the production vessel to eliminate costly and accident prone seabed flow lines and CALM buoy system.

The system described above restrains the mooring system to keep it from collapsing into the vessel when no tanker is hooked up.

The loading buoy 33 also supports the floating flow line hoses from the vessel 21, and allows the tanker to be connected up at a safe distance from the vessel.

The system includes a winch system, idler sheaves etc., to allow the connections to share the loads imparted by the tanker in moderate to heavy seas. Two of the most important features of this system are the connections and loading buoy, for it is because of these that rapid deployment and cost savings may be achieved by eliminating the seabed flowlines, PLEM's, flow line riser and CALM equipment and installation.

I claim:

1. A loading arrangement comprising a mooring system for locating a buoy adjacent to a permanently moored vessel, in which the buoy is connected to two horizontally spaced apart points on the permanently moored vessel, and is also connected to the seabed by a single tether extending downwardly from the buoy to maintain a predetermined minimum distance between the buoy and the permanently moored vessel such that the buoy floats with its connection to the two spaced apart points in tension; and in which there is means for a mobile vessel to ride to the buoy.

2. A loading arrangement as claimed in claim 1, in which there is at least one individual compensation mechanism to tension at least one of the connections between the buoy and the permanently moored vessel, such that the buoy may be controlled to translate laterally with respect to the permanently moored vessel so to make limited lateral excursions under the influence of the connections.

3. A loading arrangement as claimed in claim 1, in which the lower end of the tether is connected to a spread of anchors on the seabed.

4. A loading arrangement as claimed in claim 1, in which there is a floating transfer hose between the permanently moored vessel and the buoy.

5. A loading arrangement as claimed in claim 4, in which there is a floating transfer hose between the buoy and the mobile vessel.

6. A loading arrangement as claimed in claim 5 in which there are a plurality of floating transfer hoses between the buoy and the mobile vessel.

7. A loading arrangement as claimed in claim 1, wherein the mobile vessel is a tanker.

* * * * *